US005806092A

United States Patent [19]

Shikatani

[11] Patent Number: 5,806,092

[45] Date of Patent: Sep. 15, 1998

[54] HOCKEY GOALTENDER'S PAD WITH FLEXIBLE OUTSIDE ROLL

[75] Inventor: Brian H. Shikatani, Milton, Canada

[73] Assignee: Canstar Sports Group, Inc., Canada

[21] Appl. No.: 880,286

[22] Filed: Jun. 24, 1997

Related U.S. Application Data

[63] Continuation of Ser. No. 780,221, Jan. 8, 1996, abandoned, which is a continuation of Ser. No. 386,536, Feb. 10, 1995, abandoned.

[30] Foreign Application Priority Data

Feb. 11, 1994 [CA] Canada ..... 2115517

[51] Int. Cl.[6] ..... A41D 13/00

[52] U.S. Cl. ..... 2/22

[58] Field of Search ..... 2/2, 22, 24, 455

[56] References Cited

U.S. PATENT DOCUMENTS

| | | | |
|---|---|---|---|
| 2,640,989 | 6/1953 | Woodward | 2/22 |
| 3,945,046 | 3/1976 | Stromgren | 2/22 |
| 4,715,067 | 12/1987 | Beauregard | 2/22 |
| 4,807,301 | 2/1989 | Ferber | 2/2 |
| 4,868,926 | 9/1989 | Lowson | 2/22 |
| 5,093,931 | 3/1992 | LaBerge et al. | 2/22 |

*Primary Examiner*—Michael A. Neas
*Attorney, Agent, or Firm*—Finnegan, Henderson, Farabow, Garrett & Dunner, L.L.P.

[57] ABSTRACT

A hockey goaltender's pad is described, in which the upper segment of each side roll is sewn with darts which facilitate flexing of the rolls. As the knee is bent, the darts open, thus in effect increasing the length of the outside of the roll in response to the tensile load there, so that the outside of the roll does not restrict the flexing. As the leg is straightened again, the darts close.

19 Claims, 5 Drawing Sheets

HOCKEY GOALTENDER'S PAD WITH FLEXIBLE OUTSIDE ROLL

This application is a continuation of application Ser. No. 08/780,221, filed Jan. 8, 1996, now abandoned, which is a continuation of application Ser. No. 08/386,536, filed Feb. 10, 1995, now abandoned.

BACKGROUND OF THE INVENTION

This invention relates to ice hockey equipment, and in particular to goaltender's pads.

For some years, "goalie" pads have had outside sausage-like "rolls" running from top to bottom of the pad along the outside edge, i.e. along the right edge of the right pad and the left edge of the left pad (as seen from the wearer's viewpoint). These rolls are typically in three segments, namely an upper segment, a middle segment, and a lower segment, with breaks between each segment to facilitate flexing. The rolls are typically formed by sewing an elongated strip of synthetic leather to a similar strip of fabric at the edges, and then pulling the strips apart to form a generally cylindrical shape which is then stuffed with conventional padding material, such as polyester fibers.

Except at the breaks between the segments, the rolls are relatively inflexible. In the case of the upper segment in particular, this is not optimal, since ideally the roll would flex readily as the knee is bent and the leg is flexed, to follow the curvature of the outside of the knee.

SUMMARY OF THE INVENTION

It is an object of the invention to provide a goaltender's pad with improved flexibility.

In the invention, the upper segment of each side roll is sewn with "darts", i.e. extra tucks which facilitate flexing of the rolls. As the knee is bent, the darts open, thus in effect increasing the length of the outside of the roll in response to the tensile load there when the knee is bent, so that the outside of the roll does not restrict the flexing. As the leg is straightened again, the darts close.

Further features will be described or will become apparent in the course of the following detailed description.

BRIEF DESCRIPTION OF THE DRAWINGS

The invention will now be described in greater detail with reference to the accompanying drawings, in which.

DETAILED DESCRIPTION OF THE PREFERRED EMBODIMENT

Figure 1:
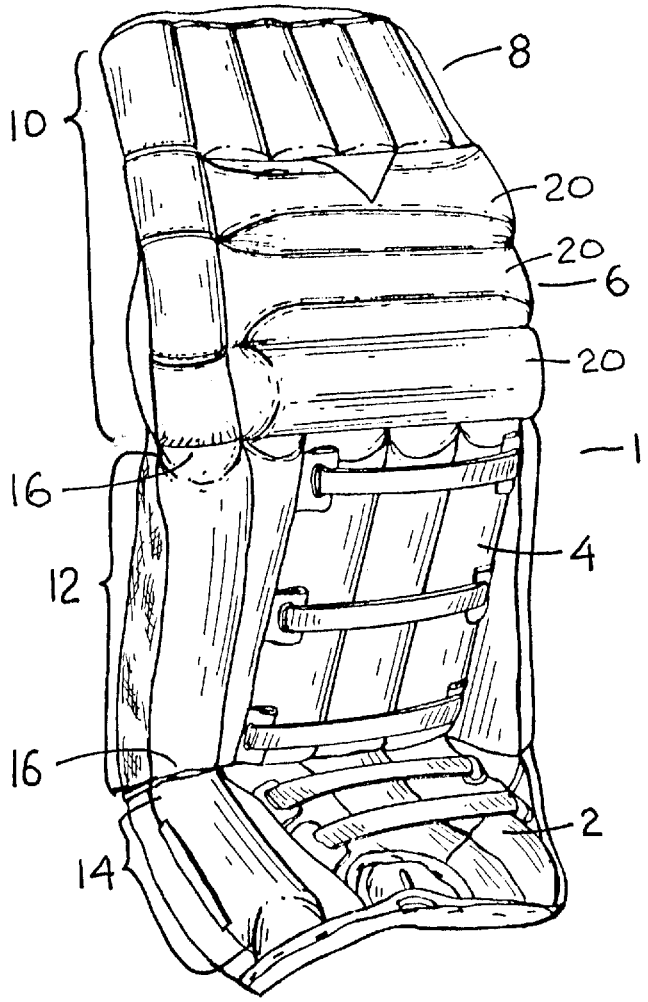
FIG. 1 is a perspective of one of the pads.

FIG. 1 shows a typical goaltender's pad 1, including a lower portion 2, a leg portion 4, a knee portion 6, and a thigh portion 8. An outside roll runs from top to bottom of the pad along the outside edge, in three segments, namely an upper segment 10, a middle segment 12, and a lower segment 14, with breaks 16 between each segment to facilitate flexing. The roll segments are stuffed with conventional padding material 17.

Figure 2:
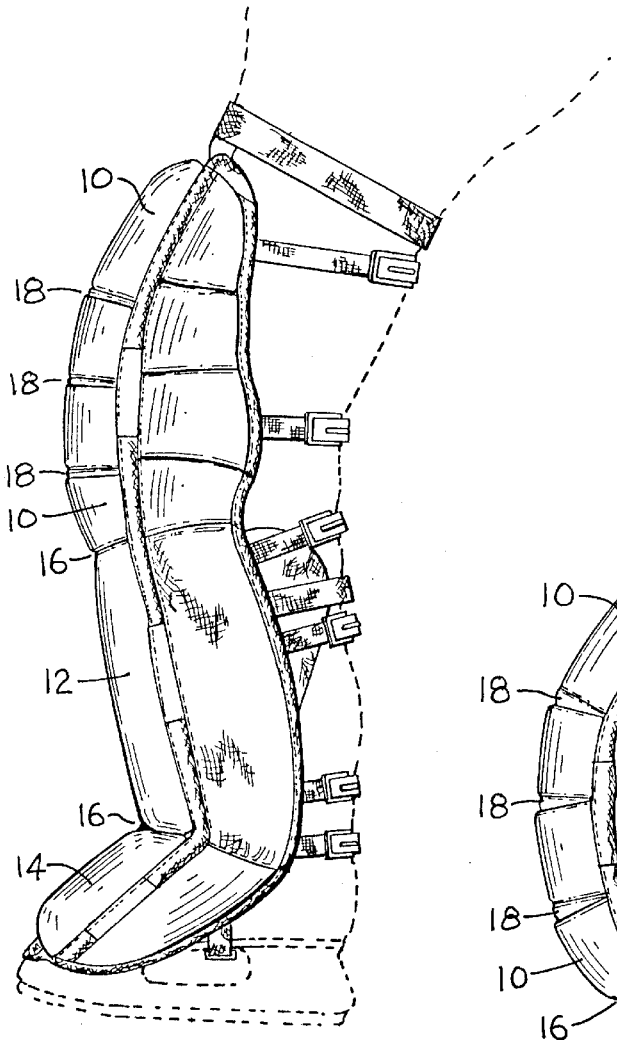
FIG. 2 is a side view of one of the pads with the goaltender's leg generally straight.
Figure 3:
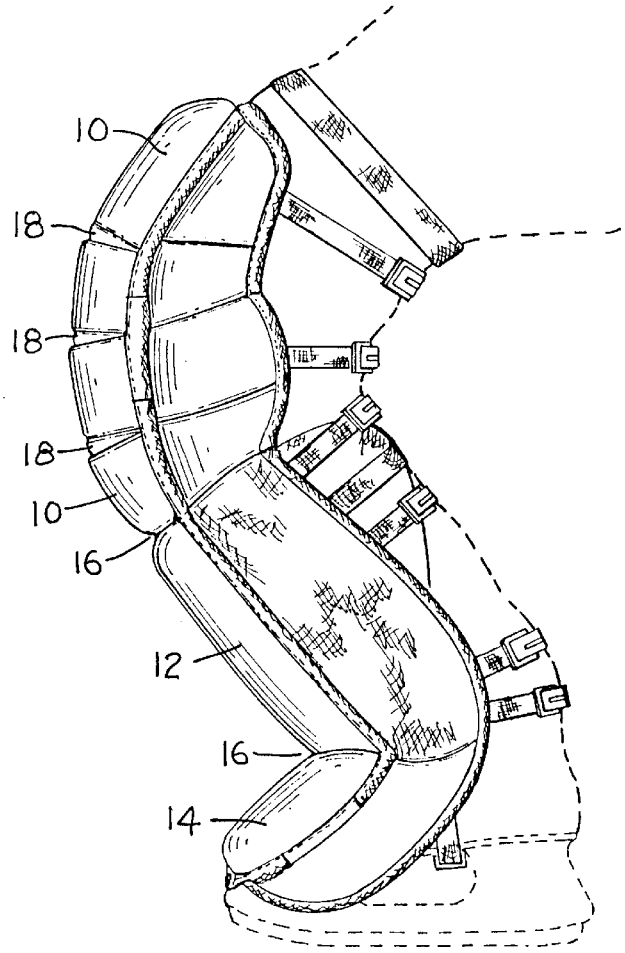
FIG. 3 is a side view similar to FIG. 2, with the goaltender's leg bent.
Figure 4:
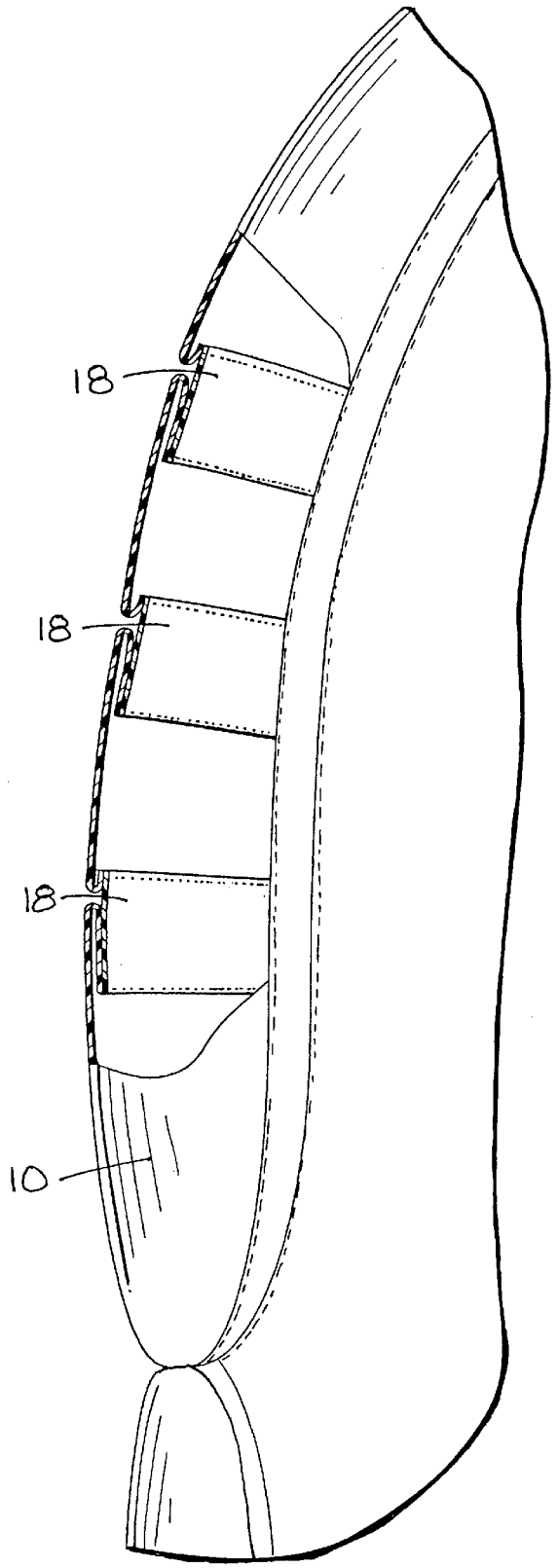
FIG. 4 is a cut-open view of the upper roll segment, showing three darts in the "as-sewn" position.
Figure 5:
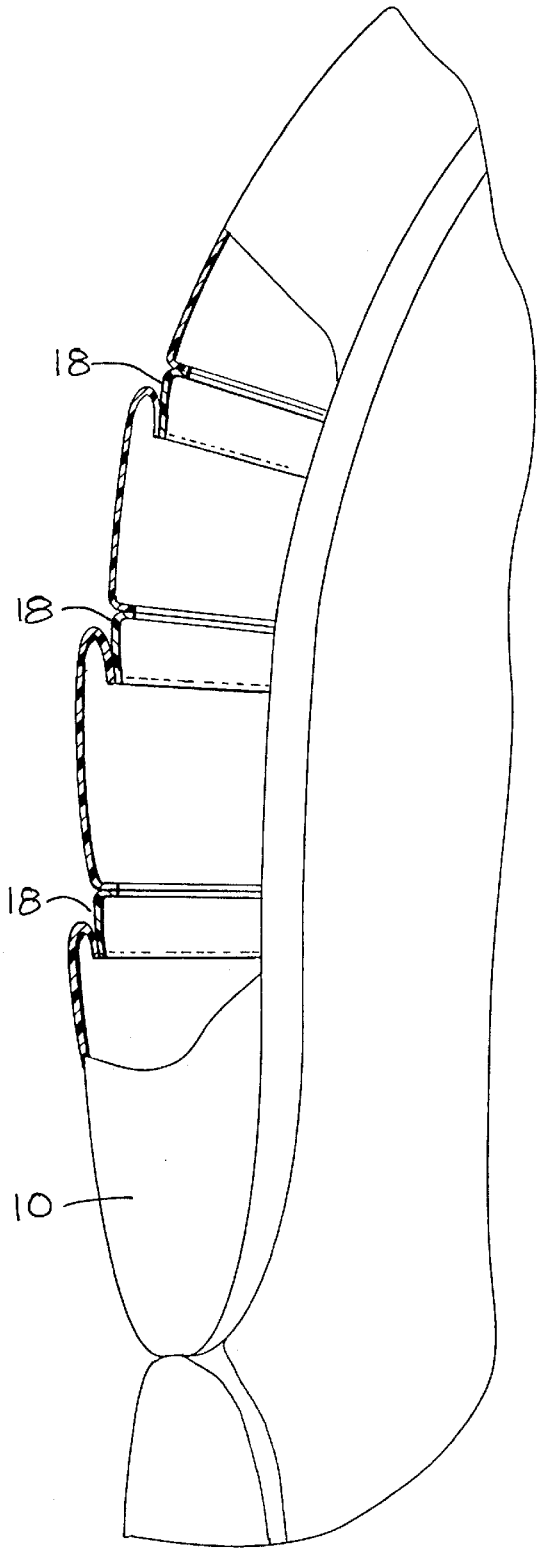
FIG. 5 is a view corresponding to FIG. 4, showing the more realistic configuration of the darts once padding has been stuffed into the roll.
Figure 6:
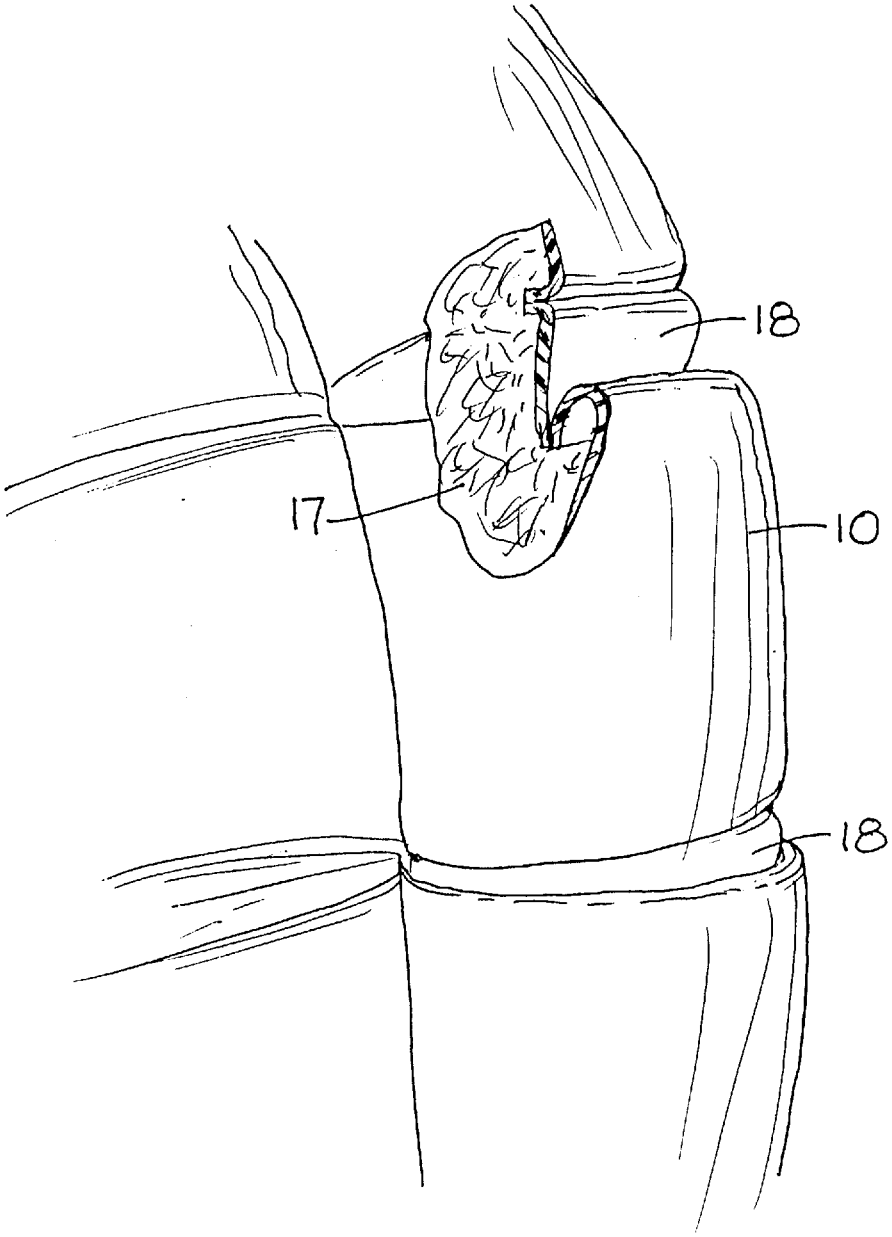
FIG. 6 is a close-up perspective view of the upper roll segment, partially cut away.

Instead of being continuous as in the conventional pads, the upper segment of the side roll is sewn with three darts 18, i.e. extra tucks which facilitate flexing of the rolls. As can be seen from FIGS. 2 and 3, as the knee is bent, the darts open, thus in effect increasing the length of the outside of the roll in response to the tensile load there, so that the outside of the roll does not restrict the flexing. As the leg is straightened, again, the darts close. This greatly improves the flexibility of the pad.

In the preferred embodiment, as best seen in FIG. 1, it should be noted that the three darts are in alignment with the margins of the lateral knee rolls 20, since the pad obviously tends to flex at those margins.

Clearly, more than three darts could be used, or fewer than three darts could be used, as desired. Alignment with the knee roll margins, although not essential, is certainly preferable.

It will be appreciated that the above description relates to the preferred embodiment by way of example only. Many variations on the invention will be obvious to those knowledgeable in the field, and such obvious variations are within the scope of the invention as described and claimed, whether or not expressly described.

I claim:

1. A goaltender pad having an upper thigh section, a knee section and a lower leg section, said sections being united to one another to provide a main padding element, said main padding element including an elongated roll that extends along a longitudinal edge portion of said padding element, said elongated roll comprising:

a first section and a second section;

a flexible joint element between said first and said second sections, said joint element being capable of acquiring an expanded condition when said main padding element is bent such that said first and said second sections are parted, said flexible joint element being capable of acquiring a collapsed condition when said main padding element is straightened;

said flexible joint element being located in an area of said knee section;

said first section, said second section and said flexible joint enclosing padding material.

2. A goaltender pad as defined in claim 1, wherein the first section, second section and flexible joint comprise material defining a cavity and wherein the flexible joint is defined by a dart in the material.

3. A goaltender pad as defined in claim 2, wherein the dart expands when said flexible joint element acquires said expanded condition.

4. A goaltender pad as defined in claim 2, wherein said dart folds between said first and said second sections when said joint element is in said collapsed condition.

5. A goaltender pad as defined in claim 1, wherein said padding material includes polyester fibers.

6. A goaltender pad as defined in claim 1, wherein each said first and second sections is generally shaped as a cylinder.

7. A goaltender pad as defined in claim 1, wherein said elongated roll includes first, second, and third sections at said knee portion, and includes a pair of flexible joint elements at respective meeting edges of said first, second and third sections.

8. A goaltender pad having an upper thigh section, a knee section and a lower leg section, said sections being united to one another to provide a main padding element, said main padding element including an elongated roll that extends along a longitudinal edge portion of said padding element, said elongated roll comprising;

a first section, a second section, and a third section, said first section meeting said second section at a first meeting zone and said second section meeting said third section at a second meeting zone in a spaced apart relationship with said first meeting zone;

a flexible joint element comprising padding material at each meeting zone, said joint element being capable of acquiring an expanded condition when said main padding element is bent such that said sections adjacent the meeting zone are parted and said flexible joint element being capable of acquiring a collapsed condition when said main padding element is straightened;

at least one of said flexible joint elements being located in an area of said knee section.

9. A goaltender pad as defined in claim 8, wherein the first section, second section and flexible joint comprise material defining a cavity and wherein the flexible joint is defined by a dart in the material.

10. A goaltender pad as defined in claim 9, wherein said padding material expands when said flexible joint element acquires said expanded condition.

11. A goaltender pad as defined in claim 10, wherein said padding material folds between respective sections of said roll when said joint element is in said collapsed condition.

12. A goaltender pad as defined in claim 11, wherein said padding material includes polyester fibers.

13. A goaltender pad as defined in claim 8, wherein each said first, second and third sections is generally shaped as a cylinder.

14. A goaltender pad including an elongated roll that extends along a longitudinal edge of said goaltender pad, said elongated roll comprising:

a first section and a second section;

a flexible joint between said first and second sections, said flexible joint being capable of acquiring an expanded position when the goaltender pad is bent and a collapsed position when the goaltender pad is straightened;

said flexible joint being padded to provide protection in both said expanded position and said collapsed position.

15. A goaltender pad as defined in claim 14, wherein said flexible joint element comprises a piece of flexible material attached to said first and second sections.

16. A goaltender pad as defined in claim 14, wherein said piece of flexible material expands when said flexible joint element acquires said expanded position.

17. A goaltender pad as defined in claim 14, wherein said piece of flexible material folds between said first and second sections when said joint element is in said collapsed position.

18. A goaltender pad as defined in claim 14, wherein said goaltender pad includes a pair of laterally extending rolls disposed generally parallel one another on opposite sides of the goaltender pad.

19. In a pad for protecting a leg of a hockey goaltender, an improved elongated roll extending along a longitudinal edge of the pad, the roll comprising:

fabric material defining an elongated cavity;

at least one dart in the fabric material that defines two adjacent sections, the dart permitting bending of the roll in response to leg movement; and padding material filling the elongated cavity, the padding material being disposed to protect the leg in the area of the dart even when the roll sections separate during leg bending.

* * * * *